United States Patent [19]

Krueckel et al.

[11] Patent Number: 5,018,892

[45] Date of Patent: May 28, 1991

[54] APPLICATOR DEVICE FOR A STICK OF SPREADABLE MATERIAL

[75] Inventors: Peter Krueckel, Heroldsberg; Gerhard Moeck, Kirchehrenbach; Robert Finkenauer, Neremberg, all of Fed. Rep. of Germany

[73] Assignee: Schwan-Stabilo Schwanhaeusser GmbH & Co., Nuremberg, Fed. Rep. of Germany

[21] Appl. No.: 481,658

[22] Filed: Feb. 14, 1990

Related U.S. Application Data

[63] Continuation of Ser. No. 226,676, Aug. 1, 1988, abandoned.

[30] Foreign Application Priority Data

Aug. 26, 1987 [DE] Fed. Rep. of Germany ..... 37282427

[51] Int. Cl.[5] ..... B43K 21/10; B43K 21/08; A45D 40/06

[52] U.S. Cl. ..... 401/68; 401/64; 401/75; 401/86; 401/87

[58] Field of Search ..... 401/55, 58, 62, 63, 401/64, 68, 70, 75–78, 81, 86–88, 95, DIG. 1; 132/320

[56] References Cited

U.S. PATENT DOCUMENTS

| | | | |
|---|---|---|---|
| 1,493,178 | 5/1924 | Wright | 401/75 X |
| 1,806,632 | 5/1931 | Lynn | 401/62 |
| 1,853,042 | 4/1932 | Deli . | |
| 3,115,118 | 12/1963 | Anderson et al. | 401/75 |
| 3,149,612 | 9/1964 | Frank | 401/63 |
| 3,197,024 | 7/1965 | Bau | 401/86 X |
| 3,230,960 | 1/1966 | Moore et al. | 401/DIG. 1 X |
| 3,358,699 | 12/1967 | Ban | 401/76 X |
| 3,601,287 | 8/1971 | Schwartzman | 401/206 X |
| 3,913,595 | 10/1975 | Grisel | 401/78 X |
| 4,461,408 | 7/1984 | Shepard | 401/206 X |
| 4,544,296 | 10/1985 | Jarvis et al. | 401/75 X |
| 4,685,820 | 8/1987 | Kremer et al. | 401/206 X |

FOREIGN PATENT DOCUMENTS

| | | |
|---|---|---|
| 137586 | 5/1934 | Austria . |
| 292690 | 6/1916 | Fed. Rep. of Germany . |
| 62874 | 11/1912 | Switzerland . |
| 167534 | 2/1934 | Switzerland . |
| 167533 | 5/1934 | Switzerland . |
| 956651 | 4/1924 | United Kingdom . |

*Primary Examiner*—Danton D. DeMille
*Attorney, Agent, or Firm*—Bachman & LaPointe

[57] ABSTRACT

An applicator device for a spreadable material in the form of a stick including a shaft-like gripping portion, and a screw portion connected to the gripping portion in axial alignment therewith and rotatable relative to the gripping portion. The screw portion encloses the stick of material, while secured to the screw portion within same is a screwthreaded sleeve mounted in screwthreaded engagement on a screwthreaded spindle which is mounted axially movably and non-rotatably in the gripping portion, so that the rotation of the screw portion and therewith the screwthreaded sleeve relative to the gripping portion causes axial movement of the spindle within the gripping portion. A pushing assembly engaging the stick is provided at the front end of the spindle and comprises a piston connected to the front end of the spindle and adapted to bear against the end face of the stick and a piston sleeve which surrounds the piston and embraces the end of the stick.

8 Claims, 3 Drawing Sheets

APPLICATOR DEVICE FOR A STICK OF SPREADABLE MATERIAL

This is a continuation of co-pending application Ser. No. 226,676, filed on Aug. 1, 1988, now abandoned.

BACKGROUND OF THE INVENTION

Various forms of applicator device for use in applying a material in the form of a stick from which the material can be applied by a spreading action are known. One such applicator device comprises a gripping portion and a screw portion which is connected to the gripping portion in axial alignment therewith and which can be rotated relative to the gripping portion. The screw portion has a central cavity for receiving the stick. Fixed to the screw portion is a sleeve having an internal screwthread mounted on a screwthreaded spindle. The spindle is mounted in the gripping portion in such a way that it cannot rotate therein but is capable of moving axially therein. By virtue of the screwthreaded engagement between the screwthreaded sleeve and the screwthreaded spindle, rotary movement as between the screw portion and the gripping portion causes the spindle to move axially within the gripping portion. The device further includes a pushing member for engaging the stick for pushing it out of and retracting it into the screw portion. The pushing member is disposed at the front end of the screwthreaded spindle so that the axial movement of the screwthreaded spindle by relative rotary movement between the gripping portion and the screw portion causes axial movement of the stick. Such a design is to be found in British patent specification No 956 651 and can be used in relation to a stick of a spreadable material, which is produced by an extrusion operation and which is thus suitably fixed to the pushing member at the front end of the screwthreaded spindle.

In that device, the gripping portion is connected to the screw portion in that, at its end towards the screw portion, the gripping portion has an inwardly turned edge with an opening therein, and the screw portion is enlarged in transverse dimension at its end part which is towards the gripping portion. The enlarged end of the screw portion thus is retained in the gripping portion by co-operating with the inwardly turned edge of the gripping portion. That design configuration means that it is not readily possible for the screw portion and the gripping portion to be disconnected from each other while in addition that device is really only intended for and suitable for use with extruded sticks.

SUMMARY OF THE INVENTION

An object of the present invention is to provide an applicator device for use with a stick of spreadable material, in which a gripping portion can be selectively combined with a variety of screw portions for use with extruded sticks or sticks which are cast in position therein.

Another object of the invention is to provide an applicator device for use with a stick of spreadable material, in which internal operating components thereof for movement of the stick in use of the device are of the same configuration irrespective of the kind of stick or stick holder used therein.

Still another object of the present invention is to provide an applicator device for use with a stick of spreadable material, which affords enhanced versatility of use while providing for reliability of operation and simplified manufacture.

According to the present invention, these and other objects are achieved by an applicator device for use with a stick of a material which can be applied by spreading same, comprising a shaft-like gripping portion and a screw portion which is connected to the gripping portion in axial alignment therewith, while being capable of rotary movement relative to the gripping portion. The stick of material to be applied is accommodated in a central cavity in the screw portion while a screwthreaded sleeve is fixed to the screw portion within same. A screwthreaded spindle is mounted in the gripping portion in such a way as to be non-rotatable therein while however being axially movable therein, for example by ribs engaging into grooves. The screwthreaded spindle is in screwthreaded engagement with the screwthreaded sleeve connected to the screw portion. The stick is engaged by a pushing member which is mounted at the front end of the screwthreaded spindle so that when the screwthreaded spindle is moved axially by relative rotary movement as between the gripping portion and the screw portion, the pushing member and therewith the stick are moved axially into and out of the screw portion, as required. The pushing member which engages the stick comprises a sleeve and a piston which is disposed within the sleeve. The piston itself is suitably connected to the front end of the screwthreaded spindle while the screw portion is in the form of a stick-containing means which can be removed from the gripping portion and fitted thereto again, being non-rotatably connected to the screwthreaded sleeve.

The pushing member preferably comprises a plastic material, with the piston and the sleeve enclosing same being produced for example in an injection molding operation with desired-rupture locations connecting same in such a way that the piston is separated from the sleeve only when the pushing member is installed in the applicator device, with the piston and the sleeve being suitably engaged together in that fashion. A pushing member of that nature, which can thus be produced in one piece, provides for ease of manufacture while on the other hand it also advantageously affords the option of fixing on the gripping portion either a screw portion which is in the nature of a stick cartridge with the stick material cast therein, or a screw portion accommodating an extruded stick. Both the stick which is cast into the stick cartridge and also the extruded stick can be screwed out of the front end of the screw portion for application of the material constituting the stick, as desired, by means of the pushing member.

In a preferred feature of the invention, the front end of the screwthreaded spindle, which is therefore towards the stick, has a ball head, while the piston preferably has a recess or cavity for receiving the ball head, to provide an axially removable but rotatable connection between the ball head and the piston. That configuration ensures that the stick can be displaced within the applicator device, between its retracted and exposed positions, without requiring a large amount of force to produce that movement.

In another advantageous feature of the invention, a spring means is disposed between the rearward end of the screwthreaded spindle, which is thus remote from the stick, and the rearward closure portion, which is remote from the screw portion of the device, of the gripping portion thereof. The spring means serves primarily to ensure that the scewthreaded spindle and the screwthreaded sleeve which is engaged with the screwthreaded spindle and also connected to the screw portion of the device are reliably brought into and held in screwthreaded engagement with each other even when the screwthreaded spindle has been moved within the applicator device into its rearmost position, that is to say the position of full retraction thereof, because in that situation the screwthreaded spindle is urged by the spring means towards the screwthreaded sleeve. The spring means also serves as a safety securing component for preventing the screw portion and the gripping portion from accidentally becoming separated from each other when the screwthreaded spindle is moved rearwardly in the device into its fully retracted position, by means of rotary movement of the screw portion. More specifically, in that rearwardly displaced position of the screwthreaded spindle, the spring means will absorb the forces which otherwise act between the screw portion and the gripping portion and would tend to separate the screw portion and the gripping portion from each other.

The above-mentioned spring means is preferably formed in one piece on the screwthreaded spindle. Such a design configuration can be easily produced as the screwthreaded spindle, like other components of the device, may desirably comprise a plastic material.

In a preferred embodiment of the applicator device according to the invention, the rearward end closure part of the gripping portion has a centering portion for holding the spring means in a generally centered position within the gripping portion. The centering portion may be a frustoconical indentation in the rearward end closure part of the gripping portion, as viewed from the outside thereof, or a frustoconical projection which points inwardly of the gripping portion, from the rearward end wall part of the gripping portion. The centering portion precisely positions the spring means and therewith the screwthreaded spindle within the gripping portion so as to provide that the applicator device can be operated without involving difficulties and without suffering from tilting or tipping as between the movable components, which could otherwise cause jamming of the device.

In a preferred construction of the applicator device according to the invention the stick-containing means is in the front of a stick cartridge into which the stick is cast. At its end part which is towards the gripping portion of the applicator device, the stick cartridge has a recess providing an abutment configuration by means of which, upon axial movement of the piston for pushing the stick out of the stick cartridge, the piston sleeve is prevented from also being moved with the piston. With that design configuration, the forward pushing movement of the stick which is cast into the stick cartridge is produced only by the piston because the piston sleeve is prevented from being moved axially in that way, by co-operating with the abutment means defined by the above-mentioned recess. As soon as the stick in the stick cartridge has been used up, the used cartridge is removed from the gripping portion and a fresh cartridge with a fresh stick cast therein is fixed into position on the gripping portion. That operation results in the new stick cartridge being non-rotatably connected to the screwthreaded sleeve which is provided in the gripping portion. Before a fresh stick cartridge is fixed to the gripping portion, the piston has to be moved back into its fully retracted rearmost position. It will be appreciated that that is done using the old used-up stick cartridge.

Instead of using a screw portion with a stick cartridge with a stick cast therein, it is also possible to use a screw portion in combination with an extruded stick, with the screw portion having a central cavity in which the piston sleeve connected to the piston is axially displaceable. The stick is arranged with its rearward end part in the sleeve surrounding the piston. That configuration of the device differs from the configuration just described above, which has a screw portion in the form of a stick cartridge with cast stick therein, in that the stick now used is an extruded component. In that construction therefore the screw portion may remain connected to the gripping portion so that a used stick only has to be replaced by a fresh extruded stick. Another difference is that it is not just the piston but both the piston and the sleeve disposed around same that are moved, when the stick is displaced in the applicator device. With that design configuration, in contrast to the applicator device which uses a stick cartridge and a stick cast therein, it is possible not only to advance the stick but also to retract it fully into the screw portion.

In the applicator device which uses an extruded stick, it has been found to be advantageous for the central cavity in the screw portion which accommodates the stick, to be provided at its front end with an abutment means for the sleeve which is disposed around the piston acting on the stick. When the sleeve around the piston moves into the foremost position of abutment against the abutment means, the piston can be moved axially forwardly by a defined distance relative to the sleeve, in order to eject the remaining part of the stick from the sleeve. That configuration provides what is referred to as an automatic ejector, with which it is easily possible for the rearward end part of the extruded stick to be ejected from the device by simply rotating the screw portion. That is possible because in the foremost position of the pushing assembly consisting of the piston and the sleeve disposed therearound, the piston also performs a defined forward pushing movement while the sleeve is in a stopped position of abutting against the abutment means defined at the front end of the cavity in which the stick is accommodated, so that the sleeve cannot move forward at the same time with the piston. Thus, until the sleeve and the piston reach the position at which the sleeve comes to bear against the abutment means in the cavity in the screw portion, the sleeve and the piston perform the same forward and retraction movements because the sleeve and the piston are sufficiently firmly connected together. However, as soon as the sleeve comes to bear against the abutment means, the connecting force connecting the piston and the sleeve together is overcome by virtue of the further forward pushing movement of the piston within the sleeve.

Irrespective of whether the applicator device involves a screw portion in the form of a stick cartridge or a screw portion for use with an extruded stick, the screwthreaded sleeve which is in screwthreaded engagement with the spindle preferably has a rearward abutment means for co-operating with the sleeve around the piston. That abutment means provides a defined limit to the retraction movement of the pushing member, more particularly the sleeve around the piston, thereby reliably preventing the piston coming loose from the sleeve around it.

Preferably, the screwthreaded sleeve carried on the screwthreaded spindle has a fine-pitch internal screwthread portion which extends along a part of the axial extent of the screwthreaded sleeve and which extends at most around half the circumferential dimension of the central hole in the screwthreaded sleeve. On the side in opposite relationship to the screwthreaded portion, the screwthreaded sleeve has an opening of dimensions corresponding to the screwthread portion. It will be appreciated that the screwthreaded spindle also has a screwthread pitch corresponding to the screwthread portion in the screwthreaded sleeve. The fine-pitch configuration of the screwthread arrangements makes it possible for the stick to be moved out of the screw portion with a very high degree of accuracy, with each turn of the screw portion producing only a comparatively small axial movement of the stick relative to the body of the applicator device. A screwthread portion of that kind, with a fine screwthread pitch, can be easily produced in the screwthreaded sleeve by means of a suitably shaped insert member in the holding tool arrangement. A screwthreaded sleeve of that nature is described in greater detail in co-pending patent application Ser. No 217,172, now abandoned, to which reference may therefore be made for a more detailed description of that arrangement.

Further objects, features and advantages of an applicator device in accordance with the principles of the present invention will be apparent from the following description of preferred embodiments thereof.

DESCRIPTION OF THE PREFERRED EMBODIMENTS

Figure 1:
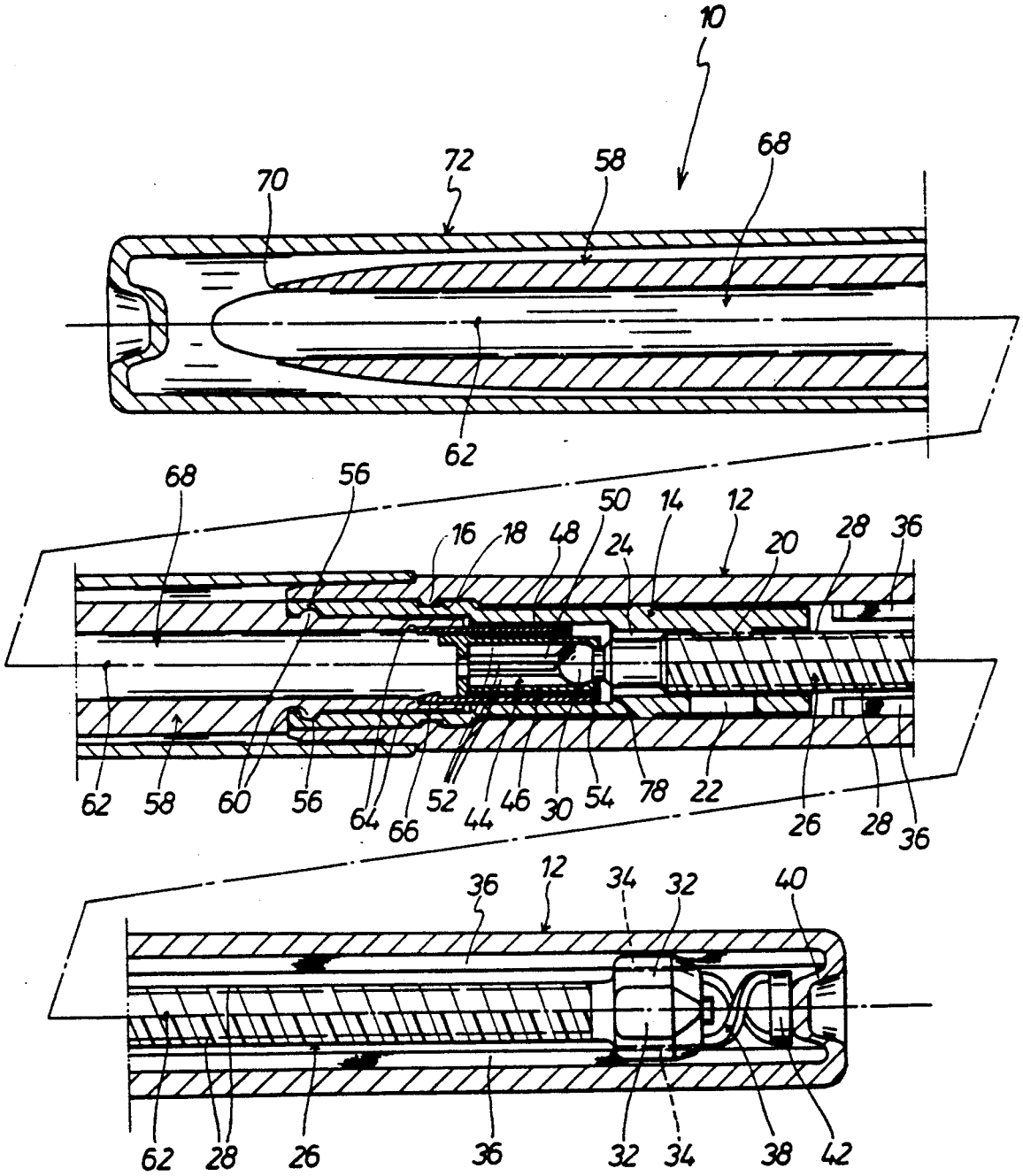
FIG. 1 is a view in section through a first embodiment of the applicator device according to the invention, with a front portion, a middle portion and a rear portion thereof being illustrated one above the other for the sake of convenience of the drawing, with the connection between those portions being diagrammatically indicated by dash-dotted connecting lines.

Referring firstly to FIG. 1, shown therein is an applicator device which is shown with a front portion, a middle portion and a rear portion arranged one above the other. It will be appreciated however, as indicated by the dash-dotted connecting lines, that the front, middle and rear portions connect together and are aligned with each other in the axial direction. Thus, starting from the rearward portion which is illustrated at the bottom part of FIG. 1, the applicator device has a shaft-like gripping portion which is indicated generally at 12 and which is open at one end, towards the left in FIG. 1, and closed at its other end, at its rearward end towards the right, by a closure wall portion 40. A screwthreaded sleeve 14 is mounted axially immovably and rotatably in the open end section of the gripping portion 12. The screwthreaded sleeve 14 is shown in the middle part in FIG. 1. To mount the screwthreaded sleeve in the gripping portion 12 in that way, the gripping portion 12 and the screwthreaded sleeve have interengaging retaining projections 16 and a groove 18. The screwthreaded sleeve 14 has a screwthread portion 20 and an opening 22 which is in diametrally opposite relationship thereto. The screwthread portion 20 is of a given axial extent and extends in the circumferential direction of the central hole or bore 24 in the screwthreaded sleeve 14, at most over half the peripheral dimension of the bore 24. The screwthread portion 20 has a very fine screwthread pitch, thus providing a fine internal screwthread therein. An arrangement of that nature is described in greater detail in co-pending patent application Ser. No 217,172, now abandoned, to which reference may therefore be made for further detail thereof.

Extending through the central hole dr bore 24 in the sleeve 14 is a screwthreaded spindle 26 having an external screwthread 28 thereon which engages with the screwthread portion 20 in the screwthreaded sleeve 14. At its one end, which is towards the left in FIG. 1, in the middle part thereof, the screwthreaded spindle 26 has a ball head 30 while at its other end part which is remote from the ball head 30 and which is thus towards the right in the lower part of FIG. 1, the screwthreaded spindle has projections 32 and between same recesses 34. Provided on the inside surface of the gripping portion 12 are longitudinally extending ribs 36 which extend through the recesses 34 which extend in the axial direction of the screwthreaded spindle, in the end part thereof. The co-operation between the longitudinal ribs 36 on the gripping portion 12 and the recesses 34 and projections 32 on the screwthreaded spindle 26 prevent the screwthreaded spindle 26 from rotating relative to the gripping portion 12 while at the same time permitting the screwthreaded spindle 26 to move axially relative to the elongate gripping portion 12.

A spring member 38 is formed integrally on the screwthreaded spindle 26 at the end thereof which is remote from the ball head 30. It will be appreciated that it would also be possible for the spring member 38 to be in the form of a loose or separate component which is inserted between the end of the screwthreaded spindle 26 and the adjoining rearward closure end wall 40 of the gripping portion 12. For the purposes of centering the spring member 38 and thus for centering the screwthreaded spindle 26 in the gripping portion 12, the rear end wall 40 of the gripping portion 12 has a frustoconical indentation therein, as viewed from the outside of the gripping portion, while the spring member 38 has an annular shoulder 42, the co-operation between the shoulder 42 and the projection formed within the end of the gripping portion 12 by the indentation in the end wall 40 providing the centering action referred to above.

Secured to the front end part of the screwthreaded spindle 26. which is at the left in the middle part of FIG. 1, is a pushing member or assembly 44 comprising a piston 46 and a sleeve 48 which is disposed around the piston 46. The piston 46 has a central cavity 50 in which there are ribs 52 extending in the lengthwise direction thereof. The ribs 52 and a circumferential shoulder portion 54 formed at the end of the piston 46 provide in the central cavitY 50 a space which accommodates the ball head 30 on the screwthreaded spindle 26. The ball head 30 can thus be resiliently engaged into the space for receiving same in the cavity 50. That therefore provides a connection between the spindle 26 and the piston 46, which is such as to permit the piston 46 and the screwthreaded spindle to rotate easily relative to each other, while however preventing axial relative movement therebetween.

Figure 3:
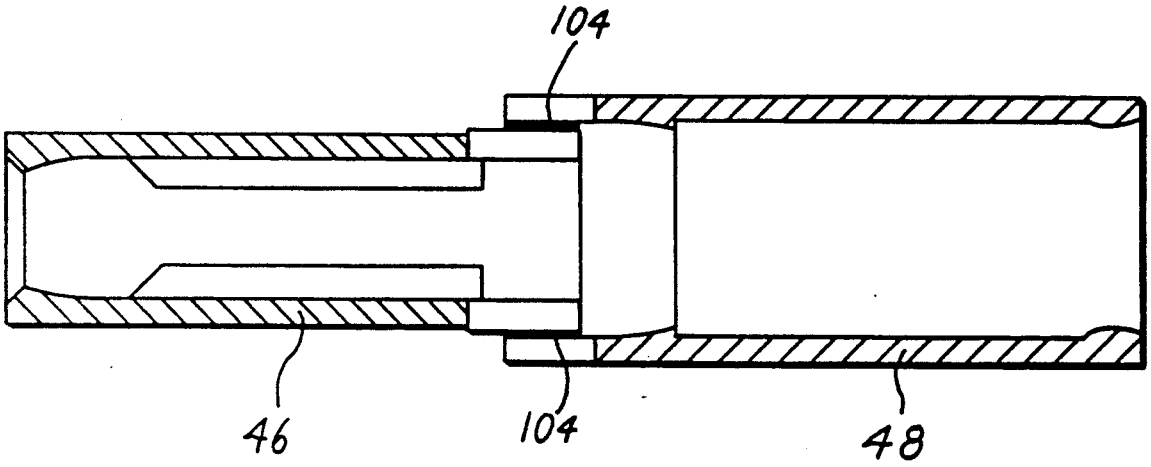
FIG. 3 is a cross sectional view of the injection molded sleeve and piston assembly used in the applicator device of FIG. 1.
Figure 4:
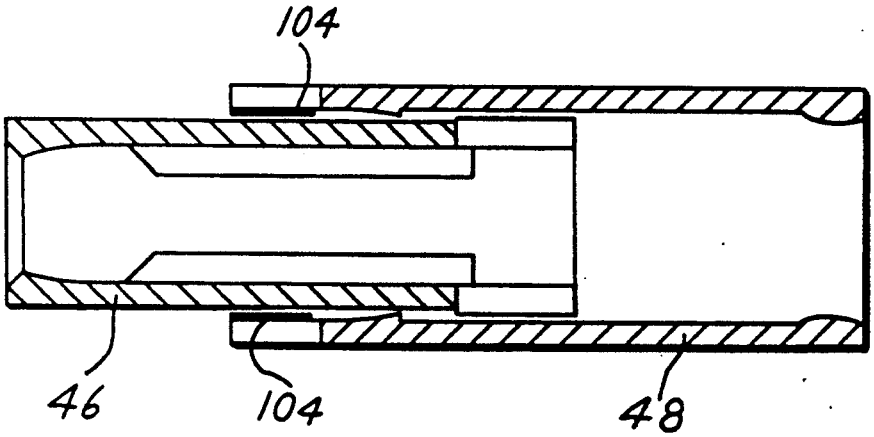

The piston 46 and the sleeve 48 may be produced in one piece in an injection molding tool designed for that purpose, with the sleeve 48 and the piston 46 directly adjoining each other in the axial direction. As shown in FIGS. 3 and 4, sleeve 48 and the piston 46 are provided with desired-rupture locations 104 at which the piston 46 and the sleeve 48 are suitably separated from each other when the pushing assembly 44 is arranged in the applicator device 10. When the piston 46 and the sleeve 48 have been separated from each other in that way, they can then be moved into the relative positions shown in the middle part of FIG. 1.

The screwthreaded sleeve 14 has recesses 56 at its end which is towards the left in the middle part of FIG. 1. A screw portion 58 has raised portions as indicated at 60, which engage into the recesses 56 in the sleeve 14 in such a way that the sleeve 14 and the screw portion 58 are fixedly connected together. Rotation of the screw portion 58 about the longitudinal center line indicated at 62 produces a rotary movement of the screwthreaded sleeve 14. As however the screwthreaded spindle 26 is prevented from rotating relative to the gripping portion 12, rotary movement of the screwthreaded sleeve 14, which is axially immovable within the gripping portion 12, results in axial movement of the screwthreaded spindle 26 within the gripping portion 12 and thus also results in axial movement of the piston 46. The sleeve 48 however is prevented from also moving with the piston 46 because the sleeve 48 is in a condition of abutment in a recess 66 which defines an abutment configuration as indicated at 64. The stick 68 of spreadable material which is disposed in the screw portion 58 is moved forwardly out of the front opening 70 of the screw portion 58, which is shown at the left in the upper part of FIG. 1, by means of the piston 46, by virtue of a rotary movement of the screw portion 58 relative to the gripping portion 12.

It will be noted that in the embodiment shown in FIG. 1, the screw portion 58 is preferably in the form of a stick cartridge into which the stick 68 of spreadable material is cast.

As soon as the material of the stick 68 has been used up, the screw portion 58 in the form of the used cartridge is removed from the gripping portion 12 and replaced by a fresh cartridge with a new stick cast therein. It will be appreciated that replacement of the old cartridge with stick 68 by a new cartridge occurs when the pushing assembly 44 is in a fully retracted position which is the position shown in FIG. 1.

In FIG. 1, reference numeral 72 identifies a closure cap for closing off the end of the applicator device 10 in order to protect the stick 68.

Figure 2:
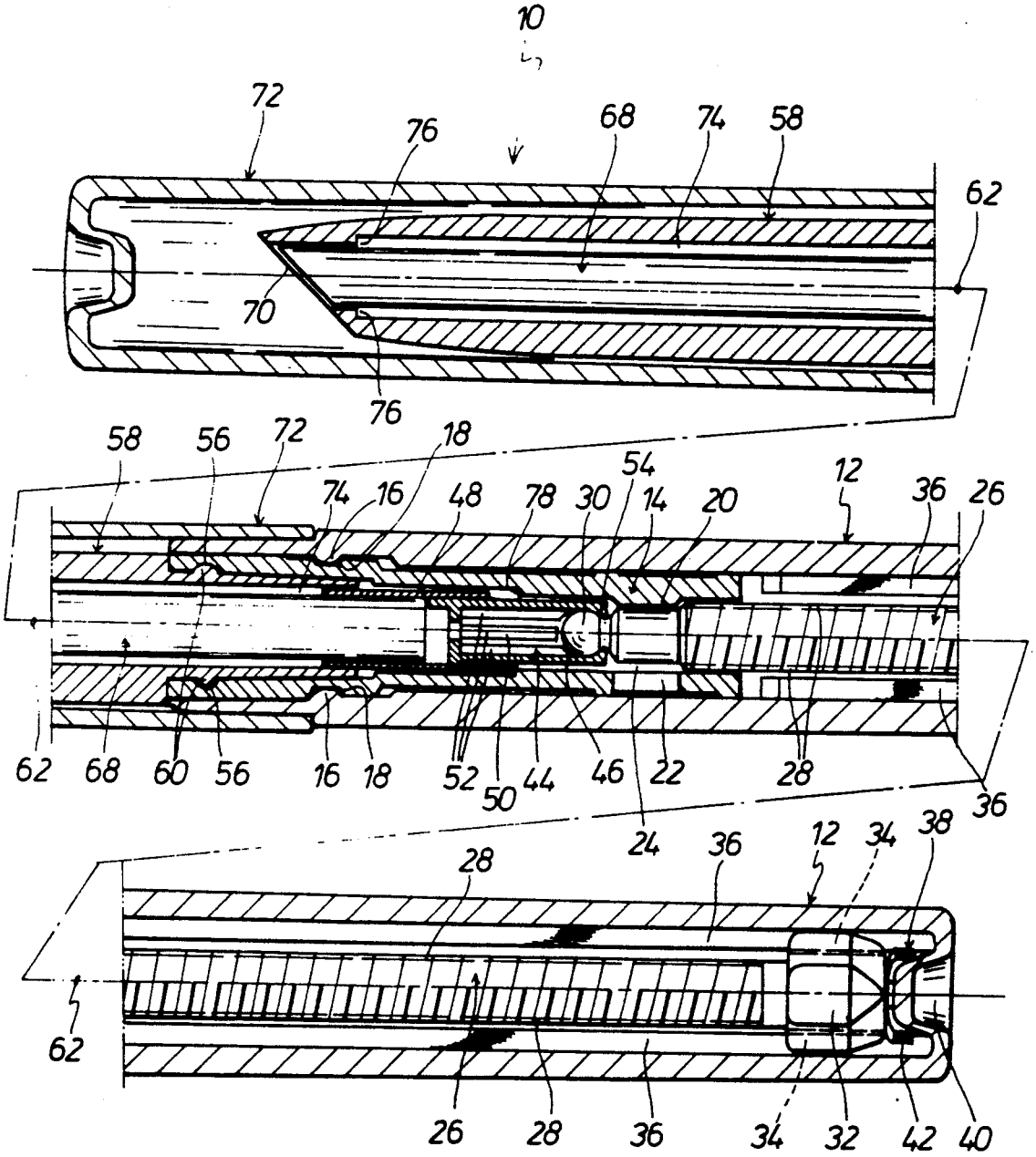
FIG. 2 is a similar view to that shown in FIG. 1, of a second embodiment of the applicator device.

Reference will now be to FIG. 2 showing a second embodiment of the applicator device 10 with a gripping portion 12, a screwthreaded sleeve 14 which is mounted rotatably but axially immovably in the gripping portion 12, a screwthreaded spindle 26 which is axially displaceable but non-rotatable in the gripping portion 12 relative thereto, a pushing assembly 44 disposed at the forward end of the screwthreaded spindle 26, a screw portion 58, a stick 68 of spreadable material and a closure cap 72.

However, the FIG. 2 configuration of the applicator device 10 differs from that shown in FIG. 1 in that the pushing assembly 44 comprises a piston 46 and a piston sleeve 48 disposed therearound, which are fixedly connected together in the manner illustrated. Thus, a rotary movement of the screw portion 58 relative to the gripping portion 12 produces a rotary movement of the screwthreaded sleeve 14 which is axially immovable in the gripping portion 12, so that the screwthreaded spindle 26 which is non-rotatable relative to the gripping portion but axially movable therein is screwed into the screwthreaded sleeve 14 and, upon suitable rotary movement of the screw portion 58, is screwed through the screwthreaded sleeve 14. Simultaneously with that forward pushing movement of the screwthreaded spindle 26 the pushing assembly 44 performs a corresponding forward movement so that the stick 68 which is fixed in the sleeve 48 also performs a corresponding movement. As the screwthreaded spindle 26 and the screwthreaded portion 20 in the sleeve 14 have a fine-pitch screwthreaded, rotary movement of the screw portion 58 produces a very sensitive and delicate forward movement of the stick 68. The stick 68 in this embodiment is an extruded stick.

FIG. 2 shows the applicator device in a condition in which the screwthreaded spindle 26 with the external screwthread 28 thereon is disengaged from the screwthread portion 20 in the screwthreaded sleeve 14; as a result of the presence of the spring member 38 which is disposed between the rearward end wall 40 of the gripping portion 12 and the projections 32 on the adjoining end of the screwthreaded spindle, the screwthreaded spindle 26 is always urged towards the screwthread portion 20 in the screwthreaded sleeve 14, with a force such as to ensure engagement can occur between the screwthread 28 on the screwthreaded spindle 26 and the screwthreaded portion 20 in the sleeve 14.

The screw portion 58 is provided with a central cavity 74 for accommodating the stick 68. At its forward end, towards the left in the upper part of FIG. 2, the cavity 74 defines an abutment configuration 76 for restricting the forward feed movement of the sleeve 48 of the pushing assembly 44. Upon suitable rotary movement of the screw portion 58, the piston 46 can be moved further forwards by a given amount. That provides for an ejection operation in respect of the end part of the stick 68, which is accommodated in the sleeve 48, so that the stick 68 can be fully ejected from the device 10 without the user having to touch the stick 68. As soon as the residual portion of stick 68 has been ejected from the device 10, the pushing assembly 44 can be returned to the fully retracted starting position, by suitable rotary movement of the screw portion 58 relative to the gripping portion 12, and a fresh extruded stick 68 can then be fitted in the central cavity 74 in the screw portion 58.

In the FIG. 2 embodiment of the device 10, the pushing assembly 44 is arranged in the cavity 74 in such a way as to be prevented from rotating so that upon movement of the screw portion, that only produces axial movement of the stick 68 out of the screw portion 58 or into the screw portion 58, without the stick 68 rotating therewith.

In FIG. 2 reference numeral 78 denotes a rearward abutment configuration which is provided on the inside of the screwthreaded sleeve 14 and which serves to limit the retraction movement of the pushing assembly 44 and in particular the sleeve 48 thereof.

It will be appreciated that the same components are identified in FIGS. 1 and 2 by the same reference numerals so that there was no need in describing FIG. 2 to describe once again in detail all the components in the FIG. 2 device.

It will also be appreciated that the foregoing embodiments of the applicator device according to the invention have been set forth solely by way of example and illustration thereof and that various modifications and alterations may be therein without thereby departing from the spirit and scope of the invention.

We claim:

1. An applicator device for a stick of a spreadable material comprising: a shaft-like gripping portion; a screw portion connected to the gripping portion in axial alignment therewith and adapted to be rotated relative to the gripping portion, said screw portion being in the form of a stick-containing means which has a cavity therein for receiving said stick and which can be removed from and fitted to said gripping portion; a screwthreaded sleeve fixed to said screw portion; a screwthreaded spindle disposed in said gripping portion non-rotatably but axially movable therein and arranged in screwthreaded engagement with said screw threaded sleeve, said screwthreaded spindle having a first end towards said cavity in said screw portion and a second end, wherein the first end is provided with a ball head; and a pushing means for displacement of said stick in said cavity in said screw portion, the pushing means being disposed at the first end of said screwthreaded spindle and comprising a piston connected to said first end of said spindle and a sleeve disposed around said piston, wherein said piston nd said sleeve disposed around said piston initially comprise a one-piece, injection molded assembly with a plurality of rupture locations, said rupture locations connecting the piston and the sleeve for allowing subsequent separation of the piston and the sleeve and the sleeve and said piston has a space for fixing said ball head to said piston such that the piston and spindle may rotate relative to each other while preventing relative axial movement therebetween, and wherein said screwthreaded sleeve includes a rearward abutment means defining an abutment with the sleeve of the pushing means.

2. An applicator device as set forth in claim 1 wherein said gripping portion has an end wall remote from said screw portion and further including a spring means disposed between the second end of said screwthreaded spindle and said end wall.

3. An applicator device as set forth in claim 2 wherein said spring means is formed in one piece on said screwthreaded spindle.

4. An applicator device as set forth in claim 2 wherein said end wall of said gripping portion has a centering portion for said spring means.

5. An applicator device as set forth in claim 1 wherein said stick-containing means comprises a stick cartridge into which said stick is cast, and wherein said stick cartridge is provided at its end part toward said gripping portion with a recess for receiving said piston and having an abutment means which, upon axial movement of said piston for pushing said stick out of said stick cartridge, is adapted to engage said sleeve to said pushing means to prevent said sleeve from also being axially moved therewith.

6. An applicator device as set forth in claim 1 wherein said cavity in said screw portion is provided at its front end with an abutment means for said sleeve of said pushing means and wherein in the position of abutment of said sleeve against said abutment means, for ejection of a residual portion of a said stick out of said sleeve, said piston is adapted to be moved axially forwardly over a defined distance relative to said sleeve.

7. An applicator device as set forth in claim 1 wherein said screwthreaded sleeve has a fine-pitch internal screwthread portion which extends along a path of the axial extent of said screwthreaded sleeve and which extends at most around half the circumferential dimension of the hole in the screwthreaded sleeve, and wherein the screwthreaded sleeve on the side in opposite relationship t said screwthread portion has an opening of dimensions corresponding to said screwthread portion.

8. An applicator device for a stick of spreadable material, comprising an elongate gripping portion; a screw portion connected to the gripping portion in axial alignment therewith and adapted for relative rotary movement with respect to the gripping portion, said screw portion being in the form of an elongate member having a cavity therein for receiving said stick slidably therewithin; a screwthreaded spindle of which at least a substantial part is disposed within the gripping portion non-rotatably but axially movable therein; said screwthreaded spindle having a first end towards said cavity in said screw portion and a second end, wherein the first end is provided with a ball head; a first sleeve having an internal screwthread means therein, in screwthreaded engagement on said screwthreaded spindle and fixed to said screw portion; and means for displacement of said stick in said cavity in said screw portion, said displacement means comprising a piston connected to said first end of said screwthreaded spindle and a second sleeve disposed around said piston, wherein said piston and said second sleeve initially comprise a one-piece, injection molded assembly with a plurality of rupture locations, said rupture locations connecting the piston and the second sleeve for allowing subsequent separation of the piston and the second sleeve and said piston has a spare for connecting said ball head to said piston such that the piston and spindle may rotate relative to each other while preventing relative axial movement therebetween, said piston in use of the device co-operating with an end face of said stick fitted into said screw portion, and said second sleeve engaging the adjoining end portion of said stick.

* * * * *

UNITED STATES PATENT AND TRADEMARK OFFICE

CERTIFICATE OF CORRECTION

PATENT NO. : 5,018,892

DATED : May 28, 1991

INVENTOR(S) : Peter Krueckel et al.

It is certified that error appears in the above-identified patent and that said Letters Patent is hereby corrected as shown below:

On the Cover page, under "Foreign Application Priority Data", delete "37282427" and insert --3728427--.

In column 2, line 56, delete "removable" and insert --immovable--.

In column 3, line 45, delete "front" and insert --form--.

In column 5, line 18, delete "holding" and insert --molding--.

In column 5, after line 41, insert --Figure 4 is a cross sectional view of the sleeve and piston assembly of Figure 3 with the piston and sleeve separated from each other.--.

In column 6, line 10, delete "dr" and insert --or--.

In column 6, line 50, delete the "." and insert a --,--.

In column 6, line 57, delete "cavitY" and insert --cavity--.

In column 7, line 2, after "4," insert --the--.

In column 8, line 12, delete "screwthreaded" and insert --screwthread--.

UNITED STATES PATENT AND TRADEMARK OFFICE

CERTIFICATE OF CORRECTION

PATENT NO. : 5,018,892

DATED : May 28, 1991

INVENTOR(S) : Peter Krueckel et al.

It is certified that error appears in the above-identified patent and that said Letters Patent is hereby corrected as shown below:

In column 9, line 24, delete "nd" and insert --and--.

In column 9, line 54, delete "to" and insert --of--.

In column 10, line 18, delete "t" and insert --to--.

In column 10, line 47, delete "spare" and insert --space--.

Signed and Sealed this

Twenty-ninth Day of September, 1992

*Attest:*

DOUGLAS B. COMER

*Attesting Officer*

*Acting Commissioner of Patents and Trademarks*